US010935264B2

(12) United States Patent
Mikulica et al.

(10) Patent No.: US 10,935,264 B2
(45) Date of Patent: Mar. 2, 2021

(54) ECONOMIZER HAVING DAMPER MODULATION

(71) Applicant: Honeywell International Inc., Morris Plains, NJ (US)

(72) Inventors: Miroslav Mikulica, Brno (CZ); Cory Grabinger, Maple Grove, MN (US); Lubos Sikora, Brno (CZ); Adrienne Thomle, Plymouth, MN (US); Jan Prostejovsky, Belotin (CZ)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 16/806,014

(22) Filed: Mar. 2, 2020

(65) Prior Publication Data

US 2020/0217533 A1 Jul. 9, 2020

Related U.S. Application Data

(60) Division of application No. 15/814,315, filed on Nov. 15, 2017, now Pat. No. 10,690,362, which is a (Continued)

(51) Int. Cl.
*F24F 11/00* (2018.01)
*F24F 11/30* (2018.01)
(Continued)

(52) U.S. Cl.
CPC ..... *F24F 11/0001* (2013.01); *F24F 11/30* (2018.01); *F24F 2011/0006* (2013.01);
(Continued)

(58) Field of Classification Search
CPC .... F24F 11/0001; F24F 11/30; F24F 2140/40; F24F 2110/10; F24F 2110/12; F24F 2011/0006
(Continued)

(56) References Cited

U.S. PATENT DOCUMENTS 2,235,022 A 3/1941 Komroff
3,589,025 A 6/1971 Hamerski
3,979,922 A 9/1976 Shavit
(Continued)

FOREIGN PATENT DOCUMENTS

JP 58142138 A 8/1983
WO 9014556 A1 11/1990
WO 2009061293 A1 5/2009

OTHER PUBLICATIONS

Burr-Brown Products from Texas Instruments, "Voltage Output Programmable Sensor Conditioner PGA 309," 87 pages, Dec. 2003.
(Continued)

*Primary Examiner* — Claire E Rojohn, III
(74) *Attorney, Agent, or Firm* — Seager, Tufte & Wickhem LLP

(57) ABSTRACT

A system having a mixed air box with inputs of return air from a space or spaces of a building, and of outside air. The mixed air box may have an output of discharge air to the space or spaces of the building. The air from the output may be return air that is conditioned with cooling, heat, or outside air. A damper may be situated at the input of outside air to the mixed air box. A temperature sensor may be positioned at the input for outside air and at the output of discharge air. A cooling mechanism may be at the output of the discharge air. The temperature sensor may be downstream from the cooling mechanism. An economizer may have connections with the damper, the temperature sensor and the cooling mechanism.

6 Claims, 1 Drawing Sheet

Related U.S. Application Data continuation of application No. 14/530,353, filed on Oct. 31, 2014, now Pat. No. 9,845,963.

(51) Int. Cl.
*F24F 110/10* (2018.01)
*F24F 110/12* (2018.01)
*F24F 140/40* (2018.01)

(52) U.S. Cl.
CPC ..... *F24F 2110/10* (2018.01); *F24F 2110/12* (2018.01); *F24F 2140/40* (2018.01)

(58) Field of Classification Search
USPC ..... 165/250
See application file for complete search history.

(56) References Cited

U.S. PATENT DOCUMENTS 4,086,781 A 5/1978 Brody et al.
4,182,180 A 1/1980 Mott
4,205,381 A 5/1980 Games et al.
4,267,967 A 5/1981 Beck et al.
4,271,898 A 6/1981 Freeman
4,280,878 A 7/1981 Sprenger
4,347,712 A 9/1982 Benton et al.
4,379,484 A 4/1983 Lom et al.
4,384,850 A 5/1983 Dixon
4,389,853 A 6/1983 Hile
4,407,266 A 10/1983 Molitor
4,415,896 A 11/1983 Allgood
4,423,364 A 12/1983 Kompelien et al.
4,495,986 A 1/1985 Clark et al.
4,497,031 A 1/1985 Froehling et al.
4,543,796 A 10/1985 Han et al.
4,570,448 A 2/1986 Smith
4,580,620 A 4/1986 Fukumoto et al.
4,591,093 A 5/1986 Elliott, Jr.
4,605,160 A 8/1986 Day
4,646,964 A 3/1987 Parker et al.
4,704,903 A 11/1987 Suga et al.
4,761,966 A 8/1988 Stark
4,838,484 A 6/1989 Kreuter
4,843,084 A 6/1989 Parker et al.
4,884,214 A 11/1989 Parker et al.
4,887,438 A 12/1989 Meckler
4,931,948 A 6/1990 Parker et al.
4,933,633 A 6/1990 Allgood
4,942,740 A 7/1990 Shaw et al.
5,103,391 A 4/1992 Barrett
5,165,465 A 11/1992 Kenet
5,276,630 A 1/1994 Baldwin et al.
5,292,280 A 3/1994 Janu et al.
5,311,451 A 5/1994 Barrett
5,385,297 A 1/1995 Rein et al.
5,390,206 A 2/1995 Rein
5,418,131 A 5/1995 Butts
5,446,677 A 8/1995 Jensen et al.
5,535,814 A 7/1996 Hartman
5,544,809 A 8/1996 Keating et al.
5,564,626 A 10/1996 Kettler et al.
5,590,830 A 1/1997 Kettler et al.
5,597,354 A 1/1997 Janu et al.
5,602,758 A 2/1997 Lincoln et al.
5,605,280 A 2/1997 Hartman
5,675,979 A 10/1997 Shah
5,706,190 A 1/1998 Russ et al.
5,719,408 A 2/1998 Yamamoto et al.
5,737,934 A 4/1998 Shah
5,762,420 A 6/1998 Mills
5,772,501 A 6/1998 Merry et al.
5,791,408 A 8/1998 Seem
5,791,983 A 8/1998 Robertson
5,801,940 A 9/1998 Russ et al.
5,874,736 A 2/1999 Pompei
5,970,430 A 10/1999 Burns et al.
6,003,507 A 12/1999 Flick et al.
6,006,142 A 12/1999 Seem et al.
6,026,352 A 2/2000 Burns et al.
6,125,540 A 10/2000 Court et al.
6,126,540 A 10/2000 Janu et al.
6,161,764 A 12/2000 Jatnieks
6,209,622 B1 4/2001 Lagace et al.
6,223,544 B1 5/2001 Seem
6,249,100 B1 6/2001 Lange
6,250,382 B1 6/2001 Rayburn et al.
6,415,617 B1 7/2002 Seem
6,487,457 B1 11/2002 Hull et al.
6,488,081 B2 12/2002 Rayburn et al.
6,491,094 B2 12/2002 Rayburn et al.
6,514,138 B2 2/2003 Estepp
6,578,770 B1 6/2003 Rosen
6,581,847 B2 6/2003 Kline et al.
6,608,558 B2 8/2003 Sen et al.
6,609,967 B2 8/2003 Sharp et al.
6,629,886 B1 10/2003 Estepp
6,634,422 B2 10/2003 Rayburn et al.
6,640,162 B1 10/2003 Swanson
6,756,998 B1 6/2004 Bilger
6,778,945 B2 8/2004 Chassin et al.
6,792,767 B1 9/2004 Pargeter et al.
6,826,920 B2 12/2004 Wacker
6,851,621 B1 2/2005 Wacker et al.
6,889,750 B2 5/2005 Lagace et al.
6,916,239 B2 7/2005 Siddaramana et al.
6,988,671 B2 1/2006 DeLuca
7,036,559 B2 5/2006 Stanimirovic
7,044,397 B2 5/2006 Bartlett et al.
7,055,759 B2 6/2006 Wacker et al.
7,059,536 B2 6/2006 Schneider et al.
7,073,566 B2 7/2006 Lagace et al.
7,099,748 B2 8/2006 Rayburn
7,104,460 B2 9/2006 Masen et al.
7,106,460 B2 9/2006 Haines et al.
7,114,554 B2 10/2006 Bergman et al.
7,177,776 B2 2/2007 Whitehead
7,222,800 B2 5/2007 Wruck
7,258,280 B2 8/2007 Wolfson
7,331,852 B2 2/2008 Ezell et al.
7,378,954 B2 5/2008 Wendt
7,398,821 B2 7/2008 Rainer et al.
7,434,413 B2 10/2008 Wruck
7,458,228 B2 12/2008 Lagace et al.
7,475,828 B2 1/2009 Bartlett et al.
7,484,668 B1 2/2009 Eiler
7,525,787 B2 4/2009 Dhindsa et al.
7,546,200 B2 6/2009 Justice
7,558,648 B2 7/2009 Hoglund et al.
7,565,225 B2 7/2009 Dushane et al.
7,574,871 B2 8/2009 Bloemer et al.
7,632,178 B2 12/2009 Meneely, Jr.
7,641,126 B2 1/2010 Schultz et al.
7,693,583 B2 4/2010 Wolff et al.
7,758,407 B2 7/2010 Ahmed
7,797,080 B2 9/2010 Durham, III
7,827,813 B2 11/2010 Seem
7,891,573 B2 2/2011 Finkam et al.
7,904,830 B2 3/2011 Hoglund et al.
7,913,180 B2 3/2011 Hoglund et al.
7,935,729 B2 5/2011 Harbige et al.
7,979,163 B2 7/2011 Terlson et al.
7,987,680 B2 8/2011 Hamada et al.
7,992,630 B2 8/2011 Springer et al.
8,027,742 B2 9/2011 Seem et al.
8,066,558 B2 11/2011 Thomle et al.
8,147,302 B2 4/2012 Desrochers et al.
8,185,244 B2 5/2012 Wolfson
8,195,335 B2 6/2012 Kreft et al.
8,200,344 B2 6/2012 Li et al.
8,200,345 B2 6/2012 Li et al.
8,219,249 B2 7/2012 Harrod et al.
8,239,168 B2 8/2012 House et al.
8,326,464 B2 12/2012 Clanin
8,364,318 B2 1/2013 Grabinger et al.

(56) References Cited

U.S. PATENT DOCUMENTS

| | | | |
|---|---|---|---|
| 8,412,654 | B2 | 4/2013 | Montalvo |
| 8,433,446 | B2 | 4/2013 | Grohman et al. |
| 8,478,433 | B2 | 7/2013 | Seem et al. |
| 8,515,584 | B2 | 8/2013 | Miller et al. |
| 8,567,204 | B2 | 10/2013 | Seem |
| 8,583,289 | B2 | 11/2013 | Stack et al. |
| 8,688,278 | B2 | 4/2014 | Kreft et al. |
| 8,719,385 | B2 | 5/2014 | Nair et al. |
| 8,719,720 | B2 | 5/2014 | Grabinger et al. |
| 8,943,848 | B2 | 2/2015 | Phannavong et al. |
| 9,097,432 | B2 | 8/2015 | Kreft et al. |
| 9,255,720 | B2 | 2/2016 | Thomle et al. |
| 9,765,986 | B2 | 9/2017 | Thomle et al. |
| 9,845,963 | B2 | 12/2017 | Mikulica et al. |
| 10,274,217 | B2 | 4/2019 | Gevelber |
| 2001/0013404 | A1 | 8/2001 | Lagace et al. |
| 2001/0042792 | A1 | 11/2001 | Kline et al. |
| 2002/0050338 | A1 | 5/2002 | Lagace et al. |
| 2002/0090908 | A1 | 7/2002 | Estepp |
| 2002/0139514 | A1 | 10/2002 | Lagace et al. |
| 2003/0110001 | A1 | 6/2003 | Chassin et al. |
| 2003/0181158 | A1 | 9/2003 | Schell et al. |
| 2004/0072535 | A1 | 4/2004 | Schneider et al. |
| 2004/0249597 | A1 | 12/2004 | Whitehead |
| 2005/0120583 | A1 | 6/2005 | Huttlin |
| 2006/0004492 | A1 | 1/2006 | Terlson et al. |
| 2006/0009862 | A1 | 1/2006 | Imhof et al. |
| 2006/0107670 | A1 | 5/2006 | Thomle et al. |
| 2006/0117769 | A1 | 6/2006 | Helt et al. |
| 2006/0130502 | A1 | 6/2006 | Wruck et al. |
| 2006/0169181 | A1 | 8/2006 | Youn et al. |
| 2006/0219381 | A1 | 10/2006 | Lagace et al. |
| 2007/0023533 | A1 | 2/2007 | Liu |
| 2007/0037507 | A1 | 2/2007 | Liu |
| 2007/0084938 | A1 | 4/2007 | Liu |
| 2007/0205297 | A1 | 9/2007 | Finkam et al. |
| 2007/0289322 | A1 | 12/2007 | Mathews |
| 2008/0052757 | A1 | 2/2008 | Gulati et al. |
| 2008/0128523 | A1 | 6/2008 | Hoglund et al. |
| 2008/0133033 | A1 | 6/2008 | Wolff et al. |
| 2008/0133061 | A1 | 6/2008 | Hoglund et al. |
| 2008/0134087 | A1 | 6/2008 | Hoglund et al. |
| 2008/0134098 | A1 | 6/2008 | Hoglund et al. |
| 2008/0176503 | A1 | 7/2008 | Stanimirovic |
| 2008/0179408 | A1 | 7/2008 | Seem |
| 2008/0179409 | A1 | 7/2008 | Seem |
| 2009/0099668 | A1 | 4/2009 | Lehman et al. |
| 2009/0143915 | A1 | 6/2009 | Dougan et al. |
| 2009/0158188 | A1 | 6/2009 | Bray et al. |
| 2009/0165485 | A1 | 7/2009 | Stark |
| 2009/0301123 | A1 | 12/2009 | Monk et al. |
| 2010/0015906 | A1 | 1/2010 | Takahashi et al. |
| 2010/0070907 | A1 | 3/2010 | Harrod et al. |
| 2010/0088261 | A1 | 4/2010 | Montalvo |
| 2010/0105311 | A1 | 4/2010 | Meneely, Jr. |
| 2010/0106308 | A1 | 4/2010 | Filbeck et al. |
| 2010/0106333 | A1 | 4/2010 | Grohman et al. |
| 2010/0106334 | A1 | 4/2010 | Grohman et al. |
| 2010/0106543 | A1 | 4/2010 | Marti |
| 2010/0123421 | A1 | 5/2010 | Grabinger et al. |
| 2010/0198411 | A1 | 8/2010 | Wolfson |
| 2010/0307733 | A1 | 12/2010 | Karamanos et al. |
| 2011/0010621 | A1 | 1/2011 | Wallaert et al. |
| 2011/0047418 | A1 | 2/2011 | Drees et al. |
| 2011/0093493 | A1 | 4/2011 | Nair et al. |
| 2011/0097988 | A1 | 4/2011 | Lord |
| 2011/0113360 | A1 | 5/2011 | Johnson et al. |
| 2011/0168793 | A1 | 7/2011 | Kreft et al. |
| 2011/0172831 | A1 | 7/2011 | Kreft et al. |
| 2011/0202180 | A1 | 8/2011 | Kowald et al. |
| 2011/0264273 | A1 | 10/2011 | Grabinger et al. |
| 2011/0264274 | A1 | 10/2011 | Grabinger et al. |
| 2011/0264275 | A1 | 10/2011 | Thomle et al. |
| 2011/0264280 | A1 | 10/2011 | Grabinger et al. |
| 2011/0308265 | A1 | 12/2011 | Phannavong et al. |
| 2012/0078563 | A1 | 3/2012 | Grabinger et al. |
| 2012/0232702 | A1* | 9/2012 | Vass ..... F24F 11/30 700/277 |
| 2012/0245968 | A1 | 9/2012 | Beaulieu et al. |
| 2013/0014927 | A1 | 1/2013 | Dazai |
| 2014/0095935 | A1 | 4/2014 | Zimmermann et al. |
| 2014/0303789 | A1 | 10/2014 | Wroblewski et al. |
| 2014/0309791 | A1 | 10/2014 | Grabinger et al. |
| 2015/0112456 | A1 | 4/2015 | Sikora et al. |
| 2015/0285524 | A1 | 10/2015 | Saunders |
| 2016/0116177 | A1 | 4/2016 | Sikora et al. |
| 2016/0123615 | A1 | 5/2016 | Mikulica et al. |
| 2016/0131381 | A1 | 5/2016 | Schmidlin |
| 2017/0051940 | A1 | 2/2017 | Horie et al. |
| 2018/0294843 | A1 | 10/2018 | Sikora et al. |

OTHER PUBLICATIONS

California Energy Commission, "2008 Building Energy Efficient Standards for Residential and Nonresidential Buildings," 176 pages, Dec. 2008.

California Energy Commission, "Reference Appendices for the 2008 Building Energy Efficient Standards for Residential and Nonresidential Buildings," 363 pages, Dec. 2008, revised Jun. 2009.

Carrier Corporation, "Getting More for Less, How Demand Controlled Ventilation Increases Air Quality and Reduces Costs," 7 pages, Dec. 1998.

Femp, "Demand-Controlled Ventilation Using CO2 Sensors," Federal Technology Alert, A New Technology Demonstration Publication, 28 pages, Mar. 2004.

Fernandez et al., "Self-Correcting HVAC Controls: Algorithms for Sensors and Dampers in Air-Handling Units," U.S. Department of Energy, PNNL-19104, 49 pages, Dec. 2009.

Hjortland et al., "General Outdoor Air Economizer Fault Detection & Diagnostics Assessment Method," Purdue University—Purdue e-Pubs, International Refrigeration and Air Conditioning Conference, 10 pages, 2012.

Honeywell, "Product Information Sheet," pp. 134-135, prior to Sep. 24, 2010.

Honeywell, "W6210A,D and W7210A,D Solid State Economizer Logic Module," Product Data, 24 pages, prior to Sep. 24, 2010.

Honeywell, "W7212, W7213, W7214 Economizer Logic Modules for Ventilation Control," Product Data, 16 pages, 2004.

Honeywell, "W7212, W7213, W7214 Economizer Logic Modules for Ventilation Control," Product Data, 24 pages, revised Mar. 2010.

Honeywell, "Building Control Systems, Use of Demand Control Ventilation in Your HVAC System," 1 page, Nov. 2005.

Honeywell, Fresh Air ECONOMIZER™ Systems, 2 pages, 1999.

Honeywell, "Jade Economizer Module (Model W7220), Installation Instructions," 20 pages, 2010.

http://av8rdas.wordpress.com/2013/01/17/retrocommisioning-findings-economizer-mi . . . , "Retrocommissioning Findings: Economizer Mixed Air Plenum Stratification—Overview," 8 pages, printed Mar. 24, 2014.

http://content.honeywell.com/building/components/pr/econstudy.asp., "Honeywell Hvac—Economizer Study," 3 pages, printed Oct. 21, 2004.

http://www.automatedbuildings.com/releases/mar09/090312111454honeywell.htm, "Honeywell Introduces Economizer Savings Tool and Selectable Dry Bulb Temperature Sensor to Reduce Energy Consumption," 2 pages, Mar. 2009.

http://www.colemparmer.com/Assets/manual, "Digi-Sense Humidity Meter Model No. 60020-40, 68X309920 Rev. 0," OakTon BlueTech Instruments, 28 pages, Jun. 2004.

http://www.nmschembio.org.uk/dm_uk/documents/lgcvam2003032_xsjgl.pdf, "Preparation of Calibration Curves, A Guide to Best Practice," LGC/VAM2003/032, 30 pages, Sep. 2003.

http://www.pexsupply.com/Honeywell-W7210A1001-Series-72-Economizer-TwoSPDT . . . , "Series-72-Economizer-TwoSPDT One 2-10VDC," SKU: W7210A1001, 2 pages, printed Sep. 7, 2010.

http://www.ti.com/lit/an/sboa111/sboa111.pdf, "A Practical Technique for Minimizing the Number of Measurements in Sensor

(56) References Cited

OTHER PUBLICATIONS

Signal Conditioning Calibration," Texas Instruments, Application Report SBOA111, pp. 1-9, Jun. 2005.
Kingrey et al., "Checking Economizer Operation," Washington State University Extension Energy Program, 3 pages, Feb. 6, 2009.
New Buildings Institute, "Commercial Rooftop HVAC Energy Savings Research Program, Draft(A) Final Project Report," 99 pages, Mar. 25, 2009.
PurpleSwift, "DC6 AHU Economizer Unit," 2 pages, downloaded Jul. 1, 2010.
Rooftop Systems, Inc., "Economizer Catalog, Version 1.1," 20 pages, downloaded Jul. 1, 2010.
Taylor, "Comparing Economizer Relief Systems," ASHRAE Journal, pp. 33-42, Sep. 2000.

* cited by examiner

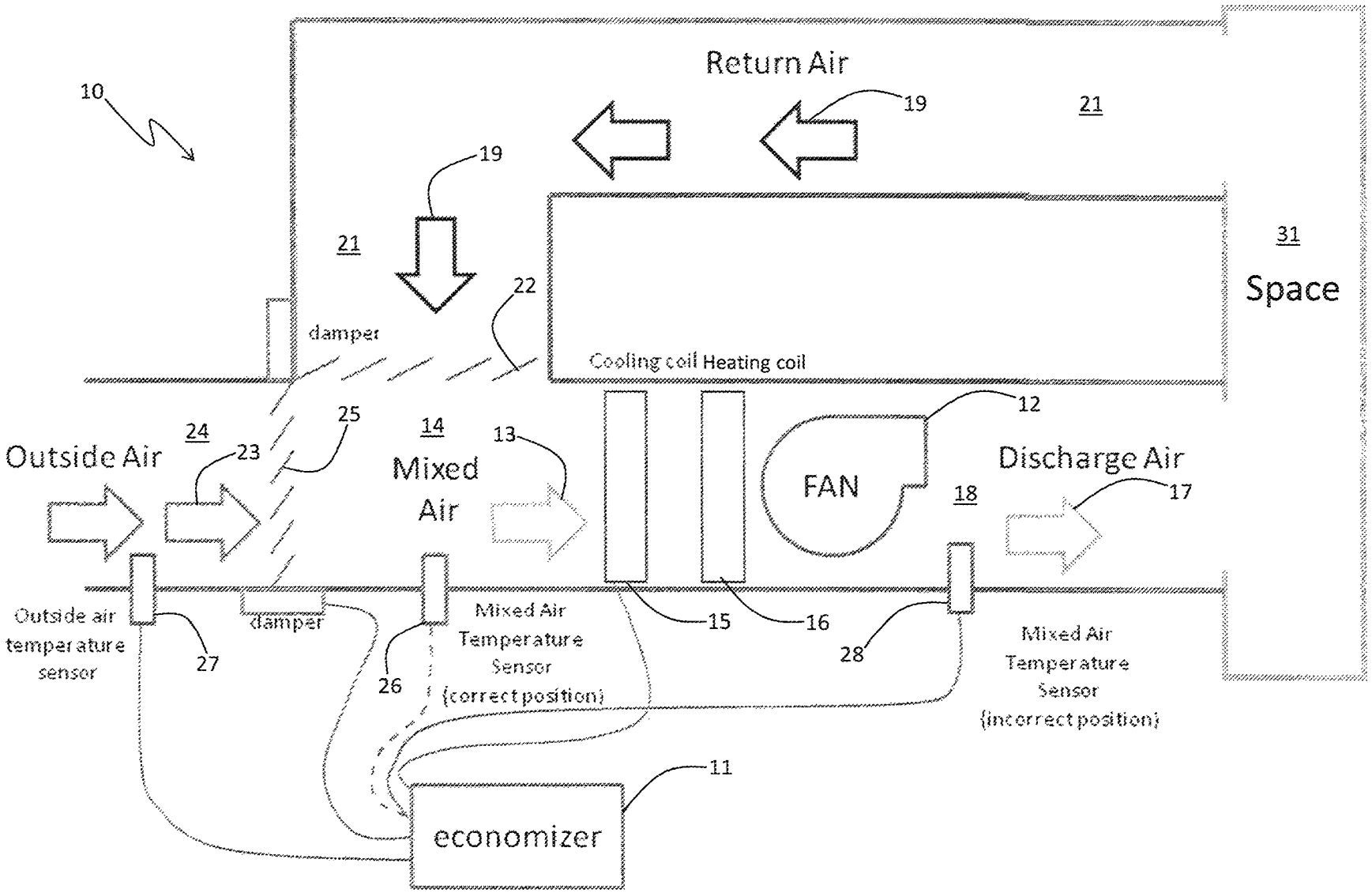
31
Space
21
Return Air
19
Cooling coil Heating coil
12
FAN
Discharge Air
17
18
Mixed Air Temperature Sensor (incorrect position)
28
16
15
11
economizer
Mixed Air Temperature Sensor (correct position)
13
14
Mixed Air
22
19
21
damper
25
26
damper
23
24
27
Outside Air
Outside air temperature sensor
10

ECONOMIZER HAVING DAMPER MODULATION

This Application is a Divisional of U.S. patent application Ser. No. 15/814,315, filed Nov. 15, 2017, which is a Continuation of U.S. patent application Ser. No. 14/530,353, filed Oct. 31, 2014.

U.S. patent application Ser. No. 14/530,353, filed Oct. 31, 2014, is incorporated by reference. U.S. patent application Ser. No. 15/814,315, filed Nov. 15, 2017, is hereby incorporated by reference.

BACKGROUND

The present disclosure pertains to building air supply systems and particularly to heating, ventilation and air conditioning systems.

SUMMARY

The disclosure reveals a system having a mixed air box with inputs of return air from a space or spaces of a building, and of outside air. The mixed air box may have an output of discharge air to the space or spaces of the building. The air from the output may be return air that is conditioned with cooling, heat, or outside air. A damper may be situated at the input of outside air to the mixed air box. A temperature sensor may be positioned at the input for outside air and at the output of discharge air. A cooling mechanism may be at the output of the discharge air. The temperature sensor may be downstream from the cooling mechanism. An economizer may have connections with the damper, the temperature sensor and the cooling mechanism.

BRIEF DESCRIPTION OF THE DRAWING

FIG. 1 is a diagram of a heating, ventilation and air conditioning system with an economizer having damper modulation based on an incorrectly located mixed air temperature sensor.

DESCRIPTION

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

FIG. 1 is a diagram of a heating, ventilation and air conditioning (HVAC) system 10 having an economizer 11 with damper modulation based on an incorrectly located mixed air temperature sensor 28. An air mover 12, such as a fan, may draw mixed air 13 from a mixed air box 14 through mechanical cooling such as a cooling coil 15 and mechanical heating such as a heating coil 16 and out as discharge air 17 from duct 18 to one or more spaces 31 of a building. Return air 19 may be drawn in from the one or more spaces 31 of the building through a duct 21. A flow of return air 19 into mixed air box 14 may be controlled by a damper 22. Also outside air 23 may be drawn in through a duct 24 to mixed air box 14. There may be an outside air temperature (OAT) sensor 27 situated in duct 24. A flow of outside air 23 into mixed air box 14 may be controlled by a damper 25. For some economizers, there may be a mixed air temperature (MAT) sensor 26 correctly situated in mixed air box 14 and connected to economizer 11. However, for many economizers there may be a MAT sensor 28 incorrectly situated in discharge air area of duct 18. Sensor 28 may be regarded as a MAT sensor for connection to economizer 11. The present system 10 is designed to appropriately modulate damper 25 based on an incorrectly placed MAT sensor 28.

Some economizers may use outside air for cooling the building when the outside air is good for economizing. The economizers may modulate an outside air input damper 25 based on a temperature sensed by a mixed air temperature (MAT) sensor 26 in mixed air box 14. This approach may work when MAT sensor 26 is installed in mixed air box 14. However, a large percentage of installations may have a MAT sensor installed at an incorrect position in the equipment; for instance, MAT sensor 28 is in a discharge air area or duct 18. When outside air 23 is good for economizing and thus cooling, but air 23 not cool enough to meet demands of a space controller, the space controller may call for a second stage of cooling. Economizer 11 may turn on cooling coil 15 and MAT sensor 28 may start measuring a lower temperature because of an engaged cooling coil 15. This may cause economizer 11 to modulate outside air damper 25 towards a closed position thereby reducing an amount of free cooling energy harnessed.

Such a situation may appear no better or could be worse in California, where the California Title 24 law allows turning on mechanical cooling coil 15 only when damper 25 is fully open (i.e., outside air 23 has to be "good to economize"). Then when damper 25 is closing, the mechanical cooling coil 15 may be turned off, and, after some time, MAT sensor 28 may warm up again, and then damper 25 may be opened again and the mechanical cooling coil 15 may be reengaged. So the system may cycle in such manner.

The present system 10 may resolve an issue of an incorrectly placed MAT sensor 28 by implementing a control function at economizer 11. When outside air 23 is good to economize, then MAT sensor 28 without an engagement of cooling coil 15 cannot necessarily report a lower temperature than OAT sensor 27 because in mixed air box 14 there may be cool outside air 23 mixed with warm return air 19 from one or more spaces 31 of the building resulting in warmer mixed air 13 and discharge air 17. But whenever outside air 23 is good for economizing and a value from MAT sensor 28 is lower than a value from OAT sensor 27, the value from OAT sensor 27 may be provided as a basis for the control loop of economizer 11 for damper 25 instead of the value from the MAT sensor 28. Due to this, damper 25 may remain open even when mechanical cooling coil 15 is turned on thereby maximizing energy savings for the building.

Economizer 11 may have logic blocks that compare an OAT value from sensor 27 and a MAT value from sensor 28, and provide the OAT value to the control loop of economizer 11 for damper 25 if the MAT value is lower than OAT value.

To recap, a heating, ventilation and air conditioning system may incorporate a mixed air box, an outside air duct connected to the mixed air box, a return air duct connected to the mixed air box, a discharge air duct connected to the mixed air box, an air mover situated in the discharge air duct, a damper situated between the outside air duct and the mixed air box, a cooling coil situated in the discharge air duct downstream from the mixed air box, an outside air temperature sensor situated in the outside air duct, a mixed air temperature sensor situated in the discharge air duct downstream from the cooling coil, and an economizer connected to the damper, the cooling coil, the outside air temperature sensor and the mixed air temperature sensor.

The economizer may compare an outside air temperature from the outside air temperature sensor with a mixed air temperature from the mixed air temperature sensor, and if the mixed air temperature is lower than the outside air temperature, then modulation of the damper by the economizer may be based on the outside air temperature.

The cooling coil may be activated only when the damper is open.

Outside air may be good for economizing when the outside air can be used for cooling return air.

When the outside air is good for economizing and the mixed air temperature is lower than the outside air temperature, then economizer may modulate the damper to be open even when the cooling coil is activated.

If the mixed air temperature is higher than the outside air temperature, then the economizer may modulate the damper according to the mixed air temperature whether or not the outside air is good for economizing.

If the cooling coil is activated, then the economizer may modulate the damper to stay open.

When the outside air is good for economizing, the mixed air temperature cannot necessarily be lower than the outside air temperature without activation of the cooling coil if in the mixer air box there is outside air mixed with return air from the return air duct that is warmer than the outside air.

The discharge air duct and the return air duct may be connected to one or more spaces of a building.

An approach for modulating a damper of a heating, ventilation and air conditioning system, may incorporate connecting an outside air duct to a mixed air box, connecting a return air duct to the mixed air box, connecting a discharge air duct to the mixed air box, measuring a temperature of outside air moving through the outside air duct, measuring a temperature of discharge air moving from the mixed air box through the discharge air duct, comparing the temperature of the discharge air with the temperature of the outside air, and controlling movement of the outside air through the outside air duct to the mixed air box according to the temperature of the outside air if the temperature of the discharge air is lower than the temperature of the outside air.

Controlling movement of the outside air through the outside air duct may be effected by a position of a damper situated between the outside air duct and the mixed air box. The position of the damper may remain unchanged if the discharge air is being cooled.

The outside air may be good for economizing when the outside air can be used for cooling return air from the return air duct in the mixed air box.

If the temperature of the discharge air is higher than the temperature of the outside air, then the outside air through the outside air duct to the mixed air box may be controlled according to the temperature of the discharge air whether or not the outside air is good for economizing.

When the outside air is good for economizing, the temperature of the discharge air may be higher than the temperature of the outside air without cooling the discharge air if the outside air is mixed with return air in the mixed air box from the return air duct having a temperature higher than the temperature of the outside air.

The discharge air duct and the return air duct may be connected to a one or more spaces of the building.

A modulated damper mechanism may incorporate a first air duct, a second air duct, a third air duct, a mixed air chamber connected to the first, second and third air ducts; a damper situated between the second air duct and the mixed air chamber, a first air temperature sensor situated in the second air duct, a second air temperature sensor situated in the third air duct, an air cooling device situated in the third air duct between the mixed air box and the second air temperature sensor, and a controller connected to the damper, the air cooling device, and the first and second air temperature sensors.

The controller may compare a temperature of the first air temperature sensor with a temperature of the second air temperature sensor. If the temperature of the second air temperature sensor is lower than the temperature of the first air temperature sensor, then control of the damper may be based on the temperature of the first air temperature sensor.

If the temperature of the second air temperature sensor is higher than the temperature of the first air temperature sensor, then the controller may control the damper according to the temperature of the second air temperature sensor.

If the air cooling device is cooling air then the controller may control the damper to be open.

The first and third air ducts may be connected to one or more spaces of a building.

In the mechanism, the first air duct may be a return air duct, the second air duct may be an outside air duct, the third air duct may be a discharge air duct, and the controller may be an economizer.

Outside air may be good for economizing when the outside air can be used for cooling air from the first air duct, in the mixed air chamber.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A modulated damper mechanism comprising:

a first air duct;

a second air duct;

a third air duct;

a mixed air chamber connected to the first, second and third air ducts;

a damper situated between the second air duct and the mixed air chamber;

a first air temperature sensor situated in the second air duct;

a second air temperature sensor situated in the third air duct;

an air cooling device situated in the third air duct between the mixed air box and the second air temperature sensor; and a controller connected to the damper, the air cooling device, and the first and second air temperature sensors;

wherein:

the controller compares a temperature of the first air temperature sensor with a temperature of the second air temperature sensor; and if the temperature of the second air temperature sensor is lower than the temperature of the first air temperature sensor, then control of the damper is based on the temperature of the first air temperature sensor.

2. The mechanism of claim 1, wherein if the temperature of the second air temperature sensor is higher than the temperature of the first air temperature sensor, then the controller will control the damper according to the temperature of the second air temperature sensor.

3. The mechanism of claim 2, wherein if the air cooling device is cooling air then the controller will control the damper to be open.

4. The mechanism of claim 3, wherein the first and third air ducts are connected to one or more spaces of a building.

5. The mechanism of claim 4, wherein:

the first air duct is a return air duct;

the second air duct is an outside air duct;

the third air duct is a discharge air duct; and the controller is an economizer.

6. The mechanism of claim 5, wherein outside air is good for economizing when the outside air can be used for cooling air from the first air duct, in the mixed air chamber.

* * * * *